United States Patent [19]

Stephen-Daly

[11] 4,253,908

[45] Mar. 3, 1981

[54] FORMING DECORATED ARTICLES

[76] Inventor: Paul Stephen-Daly, Unit 3, 3 Belmont Ave., Glen Iris, 3146 Victoria, Australia

[21] Appl. No.: 59,048

[22] Filed: Jul. 19, 1979

[30] Foreign Application Priority Data

Sep. 21, 1978 [AU] Australia ..... 40071/78

[51] Int. Cl.[3] ..... C23F 1/02

[52] U.S. Cl. ..... 156/645; 156/659.1; 156/665; 156/904; 427/275; 427/282; 427/287

[58] Field of Search ..... 156/645, 659.1, 661.1, 156/664, 665, 654, 656, 904; 427/156, 309, 259, 445, 256, 270, 272, 275, 276, 287, 282; 134/2, 40, 41

[56] References Cited

U.S. PATENT DOCUMENTS

| | | | |
|---|---|---|---|
| 2,102,162 | 12/1937 | Nierenberg | 156/645 X |
| 2,554,256 | 5/1951 | Lewis et al. | 156/645 X |
| 2,739,047 | 3/1956 | Sanz | 156/645 X |
| 2,885,273 | 5/1959 | Oelguetz et al. | 156/659.1 |
| 2,888,335 | 5/1959 | Atkins et al. | 156/664 X |
| 3,325,320 | 6/1967 | Shepherd | 156/661.1 |

*Primary Examiner*—William A. Powell

*Attorney, Agent, or Firm*—Dennison, Meserole, Pollack & Scheiner

[57] ABSTRACT

This specification discloses a method of producing decorated shaped articles from aluminium sheets involving the application of a decorative pattern to the sheet using a high temperature resistant synthetic rubber material as the etch resistant coating followed by spinning or otherwise shaping the metal sheet into the desired shape and etching the shaped sheet to partially remove metal in the regions not coated by the etch resistant material, and removing the etch resistant material from the article.

4 Claims, No Drawings

FORMING DECORATED ARTICLES

This invention relates to a method of manufacturing decorated articles from sheet metal such as aluminium and aluminium alloy sheets.

It is known to decorate flat articles of aluminium and other metals by screen printing a desired decorative effect on a sheet of metal in a material which is resistant to etching compounds such as caustic soda and acid solutions. It is also known to form articles such as plates, bowls and goblets from flat sheets by subjecting them to well known shaping techniques such as spinning.

In the case of shaped articles, it is not possible to screen print patterns directly onto the article and for this reason it has been necessary in the past to subject the formed article to the hand application of a desired pattern or decorative effect. This is of course extremely time consuming and not economically practical for volume production.

In experiments which led to the present invention, I attempted to screen print flat sheets with decorative effects using known etch resistant materials as the ink following which the sheets were subjected to spinning. However, I found that the necessary contact between the sheet metal and the spinning bar removed the pattern from the sheet thus making it impossible to etch the shaped article with the desired pattern.

After considerable experimentation I discovered that high temperature resistant synthetic rubber materials were not only resistant to acid or alkaline etchants but by using such materials as the ink in screen printing or other pattern applying prodecures, the flat sheet could be subsequently spun into any desired shape and then subsequently etched to decorate the exposed areas of the article.

Accordingly, the invention provides a method of producing decorated shaped articles from sheet metal comprising applying a decorative pattern to a clean sheet of said metal using a high temperature resistant synthetic rubber material as the etch resistant coating, spinning or otherwise shaping the metal sheet into a desired shape, etching the shaped material to partially remove the metal in the regions not coated by said etch resistant material, cleaning the etched article, and removing said coating material from the article.

The advantages of the method of the present invention are obvious. The method enables the application of the desired pattern to the flat sheet by rapid techniques such as screen printing followed by the shaping of the sheet into any desired article by known shaping techniques such as spinning. The ability to perform spinning or other shaping techniques on a decorated flat sheet enables the rapid production of articles decorated in a highly individual manner in a fraction of the time taken to decoratively etch such articles by known manual techniques.

One preferred method of decorating articles according to the invention will now be described as applied to 1150 brightening alloy aluminium sheet.

As an initial step the surface of the sheet is cleaned to remove all traces of foreign matter, particularly petroleum products. The clean sheet is then screeen printed with a desired decorative pattern using a high temperature resistant Neoprene coating material such as the material sold under the name Selleys PR785 synthetic rubber coating. This coating material is thinned with toluene to the required consistency necessary to perform as a screen printing ink. The screen printed coating is then cured either by allowing the coating to air dry for approximately two weeks or by initially drying the coating for one hour at 70° F. to remove all solvent from the coating following which the coating is dried in an oven for approximately two hours at about 250° F. to fully cure the coating.

The screen printed metal sheet is then placed in a spinning lathe and spun in the usual manner into the desired shape. During the spinning process it is necessary to lubricate the metal and this is achieved by using any known lubricant not having a petroleum base. I have found that ordinary laundry or yellow soap is suitable for this purpose although I consider that beeswax, detergent or other soap based products would be suitable.

After the metal sheet has been spun, the inside of the article and any other surface which is not to be etched is cleaned and coated with any suitable etch resistant material such as the material used to screen print the decorative pattern. It is not necessary to cure this coating unless further shaping operations are to be performed. The coated article is then dipped in an etchant bath. For example, the bath may be a hot caustic bath having a caustic concentration and temperature depending on the degree to which the article is to be etched. Where heavy etching is required the bath has a concentration of 4 ounces of caustic soda flakes per gallon of water and is heated to a temperature of approximately 90° F. For light etching a concentration of 1 ounce of caustic soda flakes per gallon of water is used with the bath temperature being approximately 45° F. Caustic soda flakes marketed under the name Aluminux by Diversey Chemicals have been found to be suitable.

The articles are then removed from the etching bath and subjected to a water spray rinse following which they are immersed in a desmutting solution. The articles are once again spray rinsed and then immersed in a bath of mineral turpentine which breaks the adhesive bond between the Neoprene coating and the article. A high flash point solvent cleaner, such as Applied 8-280 marketed by Applied Chemicals Pty. Ltd., is used in conjunction with manual or machine scrubbing to remove the coating from the articles.

The articles are then polished by means of a mechanical polisher or linisher if this effect is required. The polished or linished articles are then bright anodized or otherwise treated to protect the surface against damage. If desired a toner material is then rubbed into the etched areas to give any desired decorative effect. The article is then ready for use by the customer.

It will be appreciated that the specific etch and high temperature resistant material described above is not essential to the invention and that other materials having similar high temperature resistant and etch resistant properties may be used to define the decorative effect. Similarly, the specific etchant and cleaning materials may be replaced by any other suitable materials.

The shaping of the articles may be achieved by shaping techniques other than spinning. For example the metal may be drawn or deep drawn into the required shape without damaging the pattern of etch resistant coating.

In addition to patterns, letters and other indicia may be applied to the flat sheet using Mercator projection so that it is properly located and legible in the shaped product. Thus the term "pattern" is intended to include such indicia.

I claim:

1. A method of producing decorated shaped articles from sheet metal comprising the steps of applying a decorative pattern to a clean sheet of said metal using a high temperature resistant synthetic rubber material as an etch resistant coating, spinning the metal sheet into a desired shape, said high temperature resistant synthetic rubber etch resistant coating withstanding the high temperature generated by the spinning step and thereby maintaining the decorative pattern intact, etching the shaped material to partially remove the metal in the regions not coated by said etch resistant material, cleaning the etched article, and removing said coating material from the article.

2. A method of producing decorated shaped articles from sheet aluminum comprising the steps of cleaning the surface of the sheet to remove all foreign matter, screen printing a pattern on a surface of said sheet by means of a high temperature and etch resistant neoprene coating compound, curing said coating, spinning said coated sheet into a shaped article using a non-petroleum based lubricant, said high temperature and etch resistant coating compound withstanding the high temperature generated by the spinning step and thereby maintaining the pattern intact, immersing said article in a bath of etchant, rinsing said article, immersing said article in a desmutting solution, rinsing said article, removing said coating compound, sand blasting, finishing said article and applying a protective coating thereto.

3. The method of claim 2, wherein said coating compound is removed by applying mineral turpentine to the coating followed by scrubbing said coating with a high flash point solvent cleaner.

4. The method of claim 2 or 3, wherein said article is anodised to apply said protective coating, and further comprising rubbing a toner into said etched regions.

* * * * *